US007235008B2

(12) United States Patent
Kurosawa

(10) Patent No.: US 7,235,008 B2
(45) Date of Patent: Jun. 26, 2007

(54) TOKEN DISPENSING DEVICE WITH DECREASED LOADING ON A TOKEN DISPENSING DISK

(75) Inventor: Motoharu Kurosawa, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 397 days.

(21) Appl. No.: 10/647,707

(22) Filed: Aug. 25, 2003

(65) Prior Publication Data

US 2004/0072528 A1 Apr. 15, 2004

(30) Foreign Application Priority Data

Aug. 27, 2002 (JP) ..... 2002-247806

(51) Int. Cl.
*G07D 1/00* (2006.01)

(52) U.S. Cl. ..... 453/49; 57/33

(58) Field of Classification Search ..... 453/13, 453/33, 49, 57

See application file for complete search history.

(56) References Cited

U.S. PATENT DOCUMENTS

| | | | | |
|---|---|---|---|---|
| 3,907,278 A | | 9/1975 | Jaton | |
| 4,154,437 A | | 5/1979 | Butcheck et al. | |
| 4,355,797 A | | 10/1982 | Graef et al. | |
| 4,615,350 A | | 10/1986 | Boudville | |
| 4,895,358 A | | 1/1990 | Kawasaki | |
| 5,310,173 A | | 5/1994 | Martinez | |
| RE34,934 E | * | 5/1995 | Raterman et al. | 453/10 |
| 5,535,894 A | | 7/1996 | Ishiwata | |
| 5,607,352 A | | 3/1997 | Tani | |
| 5,711,704 A | | 1/1998 | Hughes et al. | |
| 5,924,919 A | * | 7/1999 | Hirano | 453/57 |
| 6,569,006 B1 | * | 5/2003 | Kurosawa et al. | 453/57 |

FOREIGN PATENT DOCUMENTS

| | | |
|---|---|---|
| JP | 06-092491 | 5/1994 |
| JP | 6-43767 | 6/1994 |
| JP | 6-190138 | 7/1994 |
| JP | 11-25309 | 1/1999 |
| JP | 11-353532 | 12/1999 |
| JP | 2002-92700 | 3/2002 |

* cited by examiner

*Primary Examiner*—Patrick Mackey
*Assistant Examiner*—Jeffrey A. Shapiro

(57) ABSTRACT

A token dispensing device including a storing bowl for storing the tokens and having an upper opening and a lower opening, a rotating disk for dispensing tokens one-by-one in a rotating manner located below the storing bowl. The storing bowl has a convex section for creating a quasi-jamming condition for restricting the flow of tokens from the storing bowl upper opening through the storing bowl lower opening to reduce the load on the rotating disk. The rotating disk has at least one through hole for holding and moving tokens across a base plate. A motor rotates the rotating disk.

6 Claims, 4 Drawing Sheets

TOKEN DISPENSING DEVICE WITH DECREASED LOADING ON A TOKEN DISPENSING DISK

CROSS-REFERENCE TO RELATED APPLICATION

This application is based on an application No. 2002-247806 filed in Japan, dated Aug. 27, 2002.

FIELD OF THE INVENTION

The present invention is related to a token dispensing device that stores a quantity of tokens and dispenses tokens one by one. More particularly, the present invention is related to an energy saving token dispensing device with decreased loading on a rotating disk used for dispensing the tokens.

DESCRIPTION OF RELATED ART

A token dispensing device may be included together with a banknote receiving device and a banknote dispensing device to comprise a token purchasing station for use in a gaming environment. Gaming devices are often of a standard size and it is desirable for a token purchasing station to be of a corresponding size with the gaming devices. Often a token purchasing station will be placed between gaming devices and it is desirable that the token purchasing station should have a similar profile. Alternatively, a token dispensing device may be incorporated into a vending machine or a gaming device itself.

Previously, a token dispensing device included a storing bowl for storing a quantity of tokens, a rotating disk with through holes located under the storing bowl in a base to form a housing for the rotating disk. The tokens are moved on the rotating base by the rotating disk and are dispensed one by one.

However, the structure of these dispensing devices were such that the load on the rotating disk was high, requiring a correspondingly higher amount of energy to operate. Further, to increase the rate of dispensing required increasing the speed of the rotating disk, which required even more energy. This is undesirable. To limit the amount of energy required to operate the previous token dispensing devices, the quantity of tokens was reduced to limit the loading on the rotating disk.

Alternatively, the number of through holes for retaining and moving tokens was increased. Although more tokens were moved per revolution of the rotating disk, the area of the rotating disk was also increased, causing a larger loading area for tokens descending from the storing bowl. Further, as the rotating disk diameter grows, the angular force required to turn the loaded rotating disk is also increased, resulting in higher energy consumption. For example, the starting current for a 24-Volt motor may be approximately 4 amps.

The rotating load on the rotating disk is composed of both the weight load of the tokens descending from the storing bowl and the resistance to turning caused by moving tokens at a distance from the center of rotation and the mass of the rotating structure. This angular moment increases with an increasing diameter.

Previously, solutions to the rotating load problem have included slanting the rotating disk on an angle relative to horizontal. This reduced the storage capacity as well as influenced the shape of the storing bowl, and was undesirable. Alternatively, an obstacle or impediment was located over the rotating disk, as disclosed in the Japanese laid open patent publication 11-25309 and the Japanese utility model publication 6-43767. This obstacle both decreased the storage capacity as well as increased the incidence of undesired jamming. The obstacle created a static jamming condition. A more satisfactory solution to the loading problem was needed.

SUMMARY OF THE INVENTION

The present invention addresses the limitations of the prior art by providing a token dispensing device with a decreased load both in weight on the rotating disk as well as the load resistance to turning of the rotating disk. Aspects of the present invention also reduce the incidence of unwanted jamming. Some components of the present invention may be constructed from resin compounds, yielding efficient and inexpensive manufacturability.

The novel token dispensing device includes a token storing bowl, a base plate, a rotating disk with a through hole, and an electric motor. The token storing bowl is mounted above the rotating disk, and tokens in the token storing bowl descend from the top of the token storing bowl to the bottom. The top portion of the token storing bowl has a substantially rectangular shape and comprises an upper section. The bottom portion of the token storing bowl has a substantially cylindrical shape and comprises a lower section. The intermediate portion of the token storing bowl provides various slanting surfaces to join the rectangular upper section with the cylindrical lower section.

The lower section of the storing bowl is fixed on the base plate and includes a narrowed circular convex section with a slanted enlarging section surface to allow tokens descending from the storing bowl in proximity to the convex section to partially rest upon the enlarging section and other tokens to create a loose bridge-like structure to impede or restrict the flow of tokens through the convex section, thereby creating a quasi-jamming condition. This quasi-jamming condition reduces the loading on the rotating disk thereby reducing the amount of energy consumed by the dispensing process.

The rotating disk has at least one through hole for retaining one or more tokens that are moved across the base plate and is dispensed. The surface of the rotating disk around the through hole has a cone-shaped hollow to permit tokens to more easily enter the through hole. The lower section of the storing bowl has a wider diameter below the narrowed circular convex section to extend beyond the outer edge of the through hole. The diameter of the narrowed circular convex section at the most narrow point does not extend beyond the outer edge of the through hole in order to create a conically tapered section where tokens can enter the through hole.

The rotating disk has a cone-shaped projection that extends above the narrowed circular convex section in order to agitate the descending tokens. The rotating disk is slanted at an angle from horizontal to further reduce the loading on the rotating disk.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
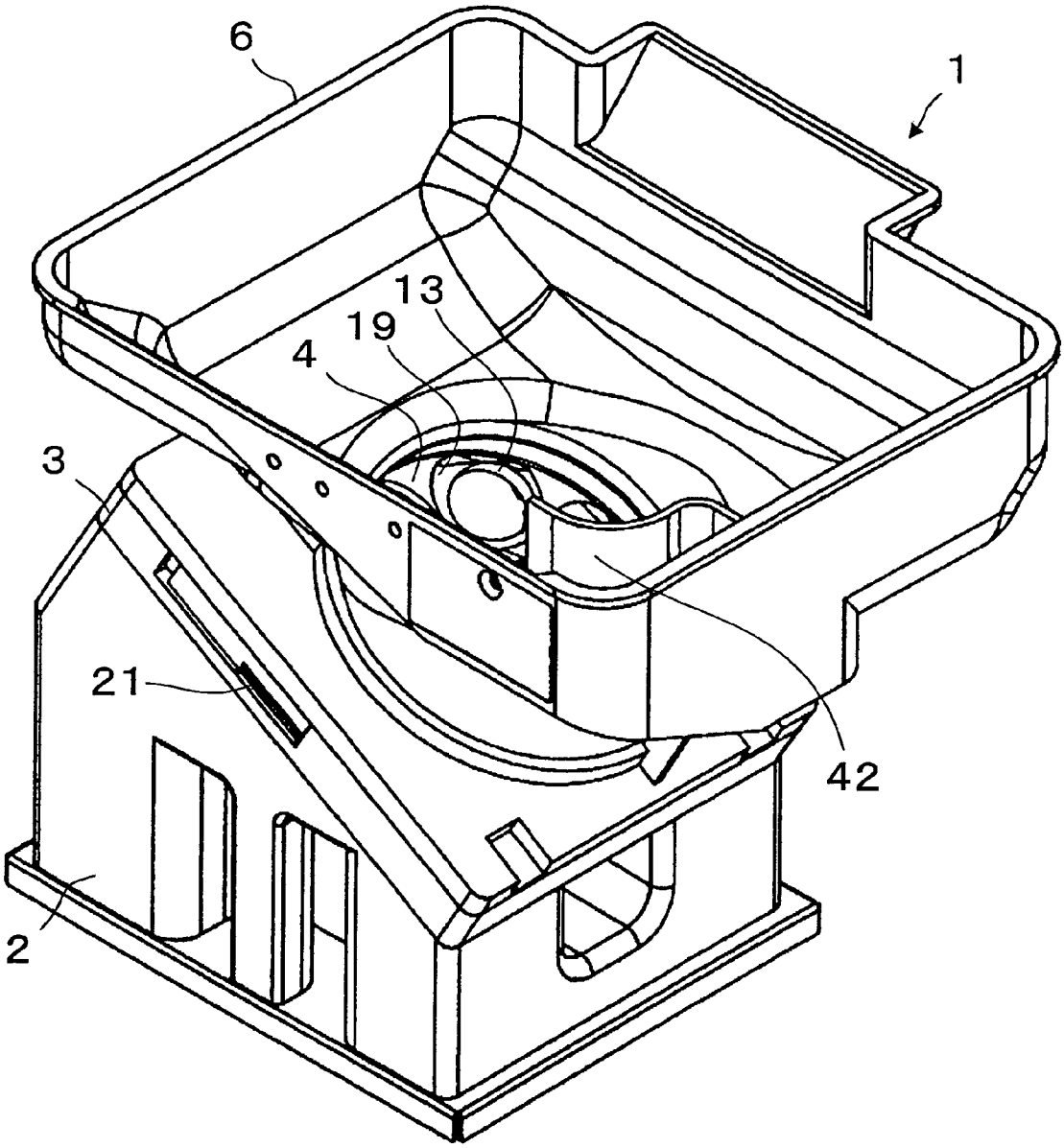
FIG. 1 shows a perspective view of an embodiment of the present invention.
Figure 3:
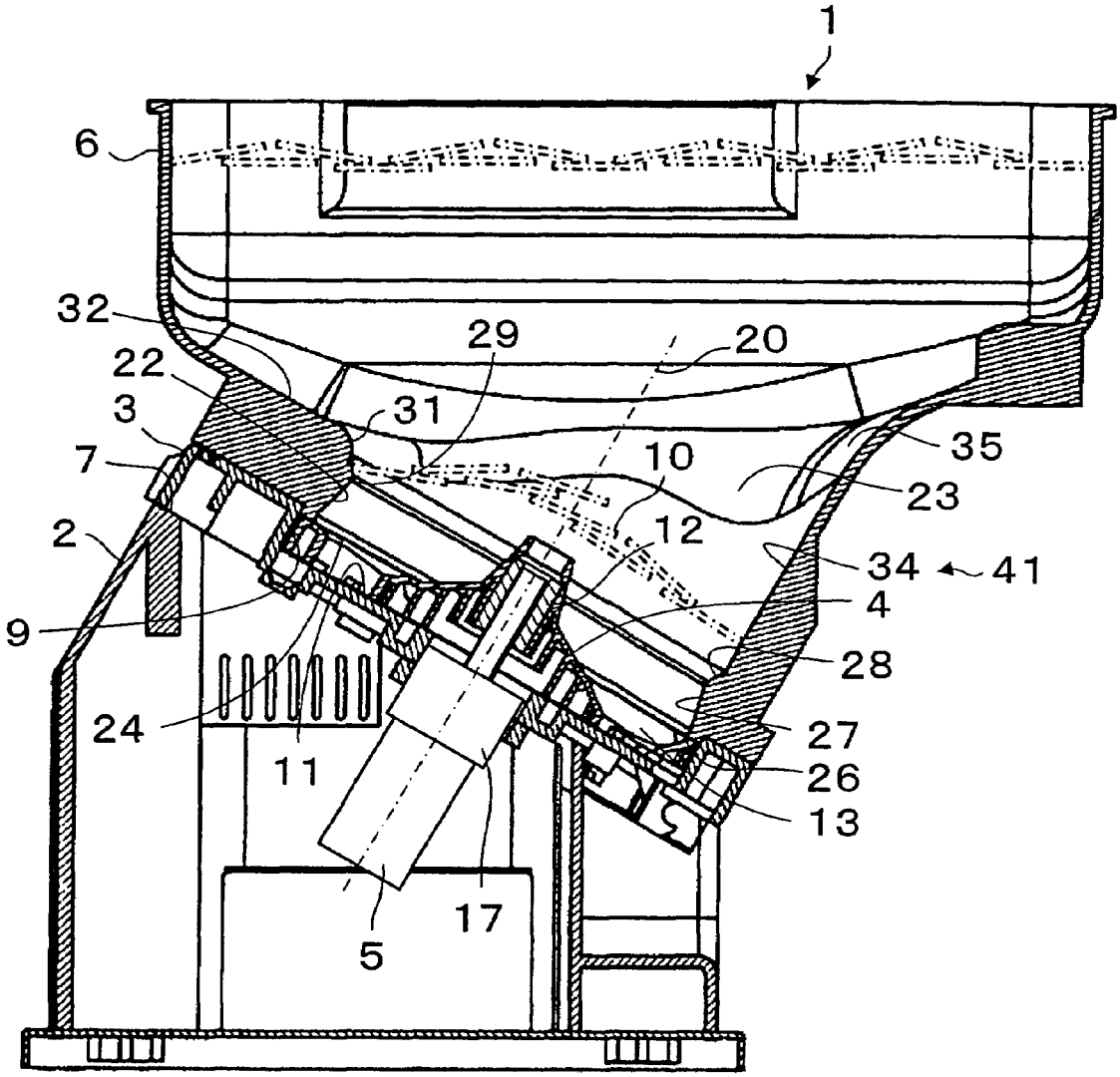
FIG. 3 shows a cross-sectional view of an embodiment of the present invention cut along the A-A line of FIG. 2.

In reference to FIG. 1 and FIG. 3, the present invention provides a novel token dispensing device 1. The token dispensing device 1 includes a base 2, a base plate 3, a rotating disk 4. an electric motor 5. and a storing bowl 6. The base 2 has a boxy, trapezoidal shape having an upper surface 7 which slants at an angle of approximately 30 degrees. The lower section of the storing bowl 6 is fixed on the base plate 3. The storing bowl 6 functions as a storing member or hopper that storm tokens for dispensing and conducts tokens received into an open upper section 14 to be discharged from a lower section 22 during the dispensing operation. As a storing member, the shape of the storing bowl 6 above the convex section in not critical.

In this specification, a token can be a coin, a medal or medallion, a disc or any similar thin article of a substantially circular shape that may be stored, manipulated, and dispensed as herein described.

The concave region 9 is circular in form and is located at the center of the base plate 3, bounded on the lower region by a planar bottom member 11. The rotating disk 4 has a cone-shaped projection 12 in the center of the rotating disk 4, the lower planar portion of the rotating disk 4 being located in the concave region 9. The rotating disk 4 has one or more through holes 13, each through hole 13 for retaining tokens as they are moved across the base plate 3.

Figure 2:
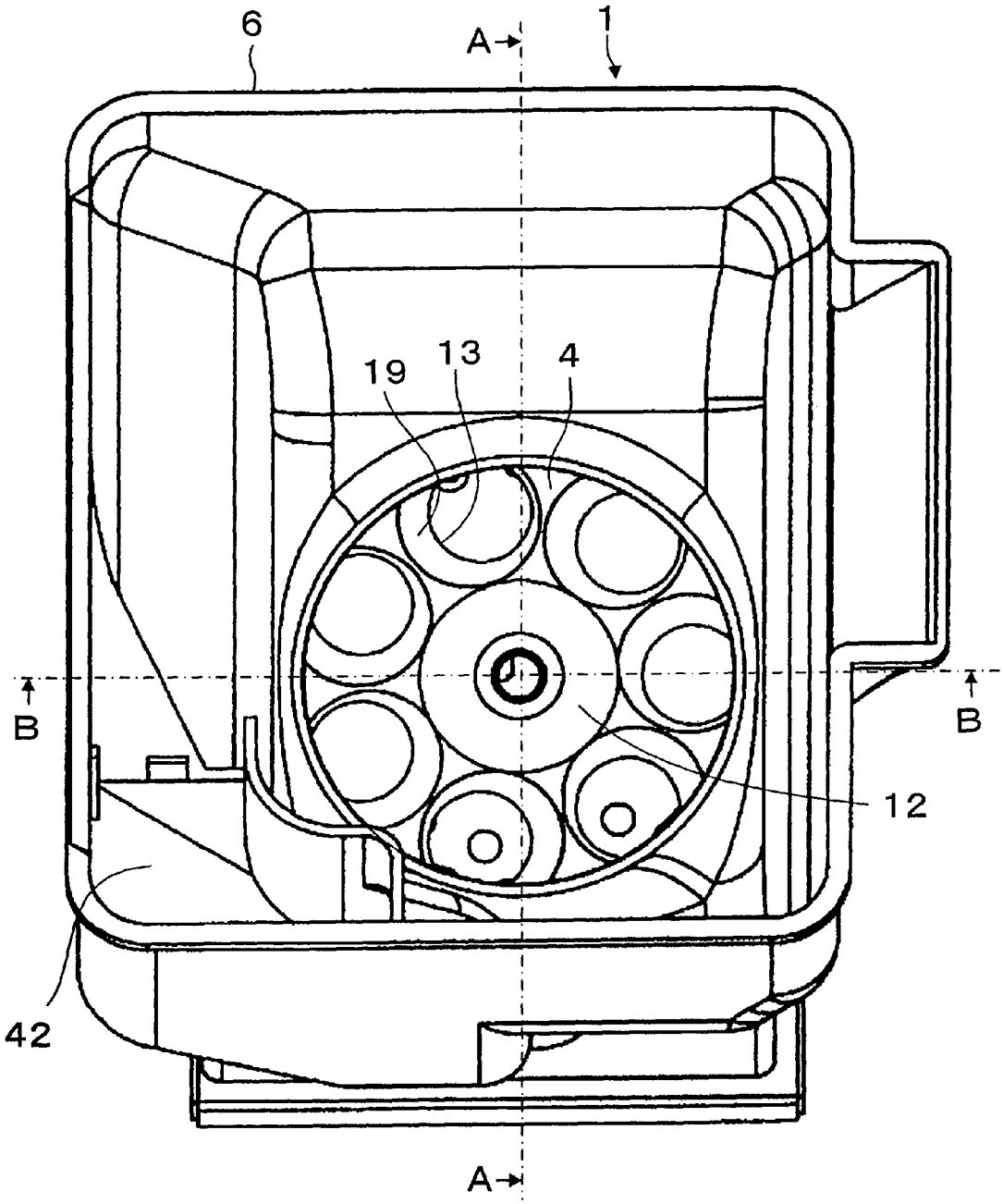
FIG. 2 shows a top view of an embodiment of the present invention, the view being normal to the axis of rotation of the rotating disk.

The number of through holes 13 may vary, but one embodiment has seven through holes 13 evenly distributed around the cone-shaped projection 12 as shown in FIG. 2. The thickness of the lower planar portion of the rotating disk 4 is the same as the depth of the concave region 9. The upper surface of the through hole 13 has a cone-shaped hollow region 19 to permit tokens 10 to enter the through hole 13 more easily. The cone-shaped hollow 19 may be located off center with the center of the through hole 13 to permit tokens to more easily enter the through hole. The cone-shaped hollow 19 may be offset on either the leading or the trailing edge in the direction of rotation of the rotating disk 4.

Shaft bushing 15 has a D-shaped cross section with a shaft hole 16 and is pressed into the projection 12 of the rotating disk 4. Motor 5 drives a reducer 17 that ultimately drives the rotating disk 4. The reducer 17 is a gear reduction or transmission device for converting a higher speed turning with a lower torque to a lower speed turning with a higher torque. The reducer 17 has an output shaft 18 for mating with the shaft hole 16. The reducer 17 operates so that for every rotation of the motor shaft the output shaft 18 driving the rotating disk makes less than one rotation. The reducer 17 is affixed to the underside of the base plate 3.

One or more tokens 10 fall under the force of gravity into the through hole 13 and are supported by the bottom member 11 to move together with the rotating disk 4 in a clockwise direction as shown in FIG. 2. A few tokens can be stacked in the through hole, the number of tokens in the through hole 13 being limited to the height of the through hole 13 which is the thickness of the rotating disk 4 at the through hole 13. The tokens 10 may be stacked vertically, but may not be aligned horizontally in the through hole 13. The token 10 in the through hole 13 is pushed by a pushing section (not shown) on the lower planar side of the rotating disk 4. A token 10 in the through hole 13 has contact with a pin which protrudes from the bottom member 11 at a predetermined position, afterwards the token 10 is guided along the peripheral direction and is dispensed from the dispensing slot 21.

The storing bowl 6 has an rectangular tube shaped upper inner section 14 and a cylindrical lower inner section 22. The axis line 20 is normal to the base plate 3. The middle inner surface 23 connects smoothly between the upper inner section 14 and the lower inner section 22. The lower inner section 22 is circular and conically tapered in shape, the taper being inclined at an angle of approximately 60 degrees relative to the planar surface of the bottom member 11.

The lower section of the lower inner section 22 is a circle and defines the lower opening 24. The lower opening 24 extends slightly over the outer edge 26 of the through hole 13. The tapered shape of the lower inner section comprises a first conically tapered section 27 and is tapered to narrow in a direction away from the base plate 3 along the axis line 20.

The enlarging section 28 is connected to the first conically tapered section 27. The enlarging section 28 comprises a second conically tapered section and is tapered to widen in a direction away from the base plate 3 along the axis line 20. The enlarging section 28 is tapered at an angle of approximately 60 degrees as measured to the axis line 20, but is tapered in the opposite direction from the first conically tapered section 27. The enlarging section 28 is shorter in length along the axis line 20 than the first conically tapered section 27. The junction between the first conically tapered section 27 and the enlarging section 28 forms an apex where the convex section has a minimum diameter, or is the most narrow.

Figure 4:
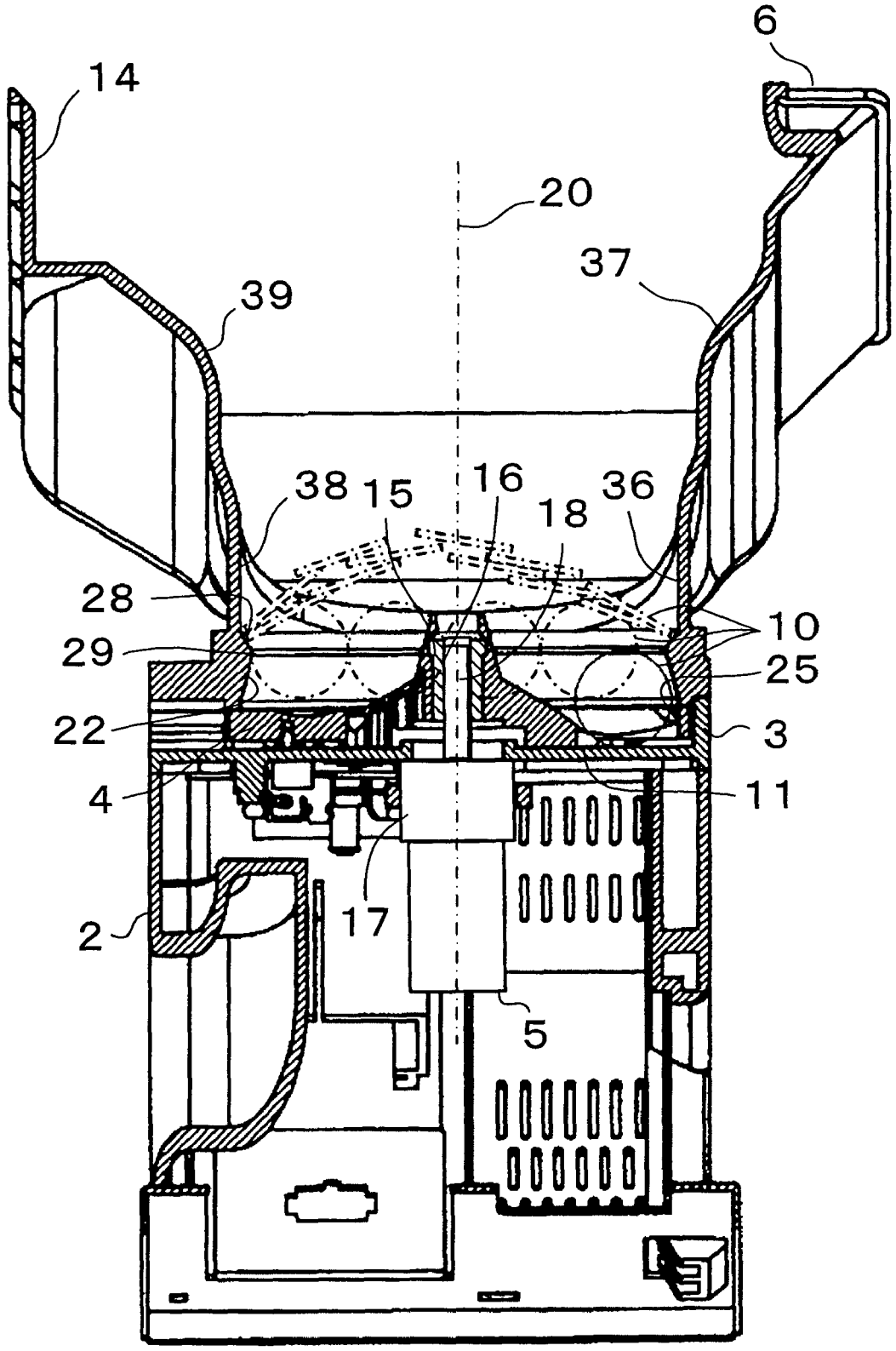
FIG. 4 shows a cross-sectional view of an embodiment of the present invention cut along the B-B line of FIG. 2.

The convex section 29 is comprised of the conically tapered section 27 and the tapered enlarging section 28. The diameter of the convex section 29 is smaller than the diameter of the lower opening 24 and is located approximately the diameter of a token away from the bottom member 11 along the axis line 20 as shown in FIG. 4. The junction of the first tapered section and the second tapered section forms an interior circular apex of the convex section 29, and is the most narrow diameter of the convex section 29.

The narrower diameter of the convex section allows tokens 10 in the storing bowl be partially supported in a quasi-jamming condition, and reduces the load on the rotating disk 4. The quasi-jamming condition restricts the movement of tokens through the convex section thereby reducing the load on the rotating disk 4. The reduced loading on the rotating disk 4 allows the motor 5 to be smaller than conventionally required. Hence, the present invention is an energy saving device.

The ratio of the diameter of the interior circular apex of the convex section 29 to the diameter of a token 10 can preferably be greater than approximately three. When the ratio of the diameter of the interior circular apex of the convex section 29 to the diameter of a token 10 is less than three, the weight of the tokens 10 on the rotating disk 4 is reduced, but there is an increased likelihood of jamming of the tokens due to the small diameter.

The ratio of the diameter of the interior circular apex of the convex section 29 to the diameter of a token 10 can preferably be less than approximately 5. When the ratio of the diameter of the interior circular apex of the convex section 29 to the diameter of a token 10 is greater than 5 the weight of the tokens increases on the rotating disk 4, and the benefit of the reduced loading is diminished.

The ratio of the diameter of the interior circular apex of the convex section 29 to the diameter of a token 10 is preferably approximately 4.3 in the preferred embodiment. This ratio has been experimentally found to yield an optimal reduction in load on the rotating disk 4, while also reducing the incidence of unwanted jamming.

The enlarging section 28 connects to the upper concave surface 31 which connects to the upper slanting surface 32 which slants parallel to rotating disk 4. The upper concave surface 31 connects to the rectangular inner face 14 through the upper slanting surface 32. The lower slanting surface 34 faces the upper slanting surface 32 and extends until the vertical position as the same upper convex surface 31 to parallel axis line 20 from enlarging section 28. The lower slanting surface 34 connects the rectangular inner surface 14 through the lower convex surface 35.

FIG. 2 shows a top view of an embodiment of the present invention, the view being normal to the axis of rotation of the dispensing disk 4. FIG. 2 shows two cut-lines A-A and B-B to show the front-back (A-A) and side-side (B-B) views. FIG. 3 shows the front-back (A-A) view where the right side of FIG. 3 is considered the front of the embodiment and the left side of FIG. 3 is considered the back of the embodiment. FIG. 4 shows the side-side (B-B) view where the left side of FIG. 4 is considered the left side of the embodiment while the right side of FIG. 4 is considered the right side of the embodiment.

As shown in FIG. 4, the right side of the enlarging section 28 connects to the rectangular inner surface 14 through the right side wall 36 and right side convex surface 37. The tapered surface of the enlarging section 28 connects to the left side wall 38 which extends approximately vertically on the left side of the embodiment and the right side wall 36 which extends approximately vertically on the right side of the embodiment. The enlarging section 28 meets the upper concave surface 31 around the back of the embodiment and the lower slanting surface 34 around the front of the embodiment.

The perpendicular section 41 extends upwards from the rotating disk 4 and includes lower slanting surface 34, right side wall 36 and left side wall 38. The left side of the rectangular upper inner surface 14 connects to the cylindrical lower left side wall 38 through the left side concave surface 39. Similarly, the right side of the rectangular upper inner surface 14 connects to the cylindrical lower right side wall 36 through the right side convex surface 37. The cylindrical section is slightly larger than the diameter of the circle enclosed by the convex section 29. The terms convex and concave are used based on the particular view and may be used to describe a curved surface that bows in or bows out.

As shown in FIG. 2, when the storing bowl 6 is over filled, the overflowing tokens will travel down chute 42. The storing bowl 6, the rotating disk 4, the base plate 3, and the base 2 can be composed of resin that is formed by casting or injection molding. Therefore, they may be manufactured economically. Although not limited to these compositions, the storing bowl 6 can be composed of acrylo-nitrile butadiene styrene (ABS) resin for superior moldability and economical manufacture. The base plate 3 can be composed of polyoxymethylene (POM), or simply polyacetal. POM is desirable for increased durability. The rotating disk 4 can be composed of polyamide (PA) mixed with carbon powder. All these components may be injection molded, or formed by casting.

The operation of the token dispensing device is now explained. Before dispensing tokens, the storing bowl 6 is filled with a quantity of tokens 10. Motor 5 rotates in response to a command to dispense a quantity of tokens. The motor 5 operates the reducer 17 to cause the output shaft 18 to turn. Rotating disk 4 is mounted on the output shaft 18 through the shaft bushing 15. Hence, when the motor 5 is activated, the rotating disk 4 is rotated in the concave region 9 in order to dispense tokens 10.

The tokens 10 in the storing bowl 6 are pulled in a downward direction under the force of gravity to move along the axis line 20 and approach the rotating disk 4. The downward movement of the tokens 10 is limited by the enlarging section 28 above the apex of the convex section 29, the upper surface of the rotating disk 4, the edge of the lower opening 24, and the bottom member 11. Some of the tokens have contact with other tokens 10 which are partially supported on the enlarging section 28 above the apex of the convex section 29.

The projection 12 is a conical structure that extends above the level of the convex section 29 and is centered on the rotating disk 4. As the rotating disk 4 rotates, the population of tokens in proximity to the rotating disk 4 is agitated by the movement of the through hole 13 and the rotating disk projection 12. This agitation allows the tokens to move and assume various attitudes and positions. The agitated tokens will tend to assume a position substantially parallel to the surface of the rotating disk 4 which is mounted on an angle.

Some quantity of tokens 10 will proceed past the apex of the convex section 29 and enter the through hole 13 of the rotating disk 4 to be dispensed in a one by one manner. Tokens cannot be located on the outer edge of the rotating disk 4 because the lower opening 24 of the storing bowl 6 is located in close proximity to the outer edge of the through holes 13. Therefore, tokens are dispensed without loss, and the number of dispensed tokens in a predetermined time is increased.

As the tokens are dispensed, the level of tokens in the storing bowl 6 will descend in a downward direction pulled by gravity toward the rotating disk 4. The quantity of tokens 10 can be refilled by adding a quantity of tokens to the storing bowl 6.

As shown in FIGS. 3-4, as the tokens descend towards the rotating disk 4, the tokens interact with other tokens 10 to create a quasi-jamming condition, that is a bridging of adjacent tokens spanning the width of the convex section 29 where most of the weight of the descending tokens is borne by the bridge-like structure formed on the enlarging section 28. Due to the agitation of the projection 12 and the movement of other tokens 10, this quasi-jamming condition is dynamic, but still significantly reduces the load on the rotating disk 4, and permits the use of a smaller motor 5 resulting in energy savings. Alternatively, a larger quantity of tokens may be dispensed using a motor of the conventional size, or the same quantity of tokens may be dispensed using a motor of a smaller size.

Although the base upper surface 7 is shown as slanting at approximately 30 degrees from horizontal, the base upper surface 7 may alternatively be located horizontally. The energy savings benefit of the reduced diameter of the convex section 29 is still apparent. However, the slanted base upper surface 7 is preferred since the weight of the descending tokens 10 on the rotating disk 4 is also reduced due to the angle of inclination. These two energy saving effects are independent, but cooperate in this embodiment. For example, the starting current for a 24-Volt motor may be reduced to approximately 3 amps for a token dispenser of the present invention compared with the previous starting current for a 24-Volt motor of approximately 4 amps for a token dispenser of the same approximate capacity.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A method of dispensing tokens from a storing bowl having a rotating disk at a bottom of the storing bowl, the rotating disk having at least one through hole for retaining and moving tokens in the storing bowl, comprising;

providing a plurality of tokens of a predetermined diameter for storage in the storing bowl;

restricting a convex section circular opening in a convex section in the storing bowl, above and adjacent the rotating disk, of a diameter between approximately 3 and 5 times the predetermined diameter of the tokens for restricting movement of the tokens to the rotating disk; and moving the rotating disk to selectively receive and release individual tokens from the plurality of tokens in the storage bowl at a rate of rotation to create a loose bridge-like structure of tokens in the storage bowl across the circular opening to intentionally restrict the flow of tokens through the convex section and reduce a bulk token weight loading on the rotating disk relative to a storage bowl having an opening greater than 5 times the predetermined diameter of the tokens.

2. The method of dispensing tokens of claim 1, wherein the storing bowl convex section includes the convex section circular opening is located over an outer edge of the through hole, a conically tapered section which extends upwards from the circular opening, and an enlarging section which is horn-like in shape and which extends upwards from the conically tapered section, the enlarging section being located above the conically tapered section, wherein the junction of the conically tapered section and the enlarging section forms an apex where the convex section has a minimum diameter.

3. The method of dispensing tokens of claim 2, wherein the apex of the convex section is located above a base plate at a distance approximately equal to the diameter of a token.

4. The method of dispensing tokens of claim 3, wherein a space is enclosed by the convex section and the diameter of the convex section circular opening is more than approximately three times the diameter of the plurality of tokens.

5. The method of dispensing tokens of claim 4, wherein the storing bowl has left and right side wall members which extend vertically upwards from the enlarging section.

6. The method of dispensing tokens of claim 5, wherein the rotating disk has a center section which extends upwards a distance above the convex section circular opening, the rotating disk center section for agitating tokens in the storing bowl.

* * * * *